US005589820A

United States Patent [19]

Robinson et al.

[11] Patent Number: 5,589,820

[45] Date of Patent: Dec. 31, 1996

[54] RETAIL THEFT PREVENTION AND INFORMATION DEVICE

[75] Inventors: Donald G. Robinson; Michael W. Geatz, both of Fargo, N. Dak.; Michael J. Corcoran, Bend, Oreg.

[73] Assignee: PAC/SCAN, Inc., Bismarck, N. Dak.

[21] Appl. No.: 540,901

[22] Filed: Oct. 11, 1995

Related U.S. Application Data

[63] Continuation of Ser. No. 131,663, Oct. 5, 1993, abandoned.

[51] Int. Cl.[6] ..... G08B 13/18

[52] U.S. Cl. ..... 340/572; 340/571; 340/540; 340/539

[58] Field of Search ..... 340/572, 571, 340/933, 551, 540, 539; 342/61

[56] References Cited

U.S. PATENT DOCUMENTS

| | | | |
|---|---|---|---|
| 3,810,147 | 5/1974 | Lichtblau | 340/572 |
| 3,859,652 | 1/1975 | Hall et al. | 340/572 |
| 3,863,244 | 1/1975 | Lichtblau | 340/572 |
| 3,868,669 | 2/1975 | Minasy | 340/572 |
| 4,123,749 | 10/1978 | Hartmann et al. | 340/572 |
| 4,274,089 | 6/1981 | Giles | 29/256 |
| 4,498,076 | 2/1985 | Lichtblau | 340/572 |
| 4,728,938 | 3/1988 | Kaltner | 340/572 |
| 4,800,369 | 1/1989 | Gomi et al. | 340/572 |
| 4,812,822 | 3/1989 | Feltz et al. | 340/572 |
| 4,851,815 | 7/1989 | Enkelmann | 340/571 |
| 5,019,815 | 2/1991 | Lemelson | 340/933 |
| 5,027,107 | 6/1991 | Matsuno et al. | 340/572 |
| 5,059,951 | 10/1991 | Kaltner | 340/572 |
| 5,103,210 | 4/1992 | Rode et al. | 340/572 |
| 5,111,186 | 5/1992 | Narlow et al. | 340/572 |
| 5,151,684 | 9/1992 | Johnsen | 340/572 |

*Primary Examiner*—Jeffery Hofsass
*Assistant Examiner*—Albert K. Wong
*Attorney, Agent, or Firm*—Dorsey & Whitney

[57] ABSTRACT

A device for use in preventing theft of an item from a building and for use in identification of the item is disclosed. The device comprises an antenna adapted to receive a frequency signal from an external device and for generating a voltage in response to receiving the frequency signal; a capacitor coupled to the antenna for storing the antenna voltage and for supplying an activation signal; a piezoelectric device for receiving an activation signal; a power supply; a memory device for digitally storing the code and for outputting the digital code upon receiving power from the power supply; a switch with normally open contacts coupled to the capacitor and to the piezoelectric device, the switch being operable to couple the power supply to the memory device upon the piezoelectric device receiving an activation signal; and a voltage to frequency converter, coupled to the memory device, for converting the digital code to frequencies representing the digital code, the voltage to frequency converter being coupled to the antenna so that the antenna transmits the frequencies representing the code.

18 Claims, 1 Drawing Sheet

RETAIL THEFT PREVENTION AND INFORMATION DEVICE

This is a continuation of application Ser. No. 08/131,663 filed Oct. 5, 1993 now abandoned.

FIELD OF THE INVENTION

This invention relates to the retail industry, and more particularly, to a device and system for detecting retail theft and for providing pricing information and inventory tracking for products sold in retail establishments and the like.

BACKGROUND OF THE INVENTION

Employee and consumer theft is a significant problem in the United States. It is estimated that such theft costs merchandising retailers billions of dollars each year. These losses result in higher merchandise prices to the consumer and require the retailers to spend a substantial amount in an attempt to prevent, and minimize such losses.

Many stores have hired and continue to hire security guards to observe and apprehend shoplifters. Similarly, many stores have installed video cameras throughout the store and have positioned monitors in a central location for viewing by a guard. Nevertheless, such systems suffer from significant limitations. To begin, stores are required to spend a substantial amount of money to install such systems and pay salaries to guards. Further, at best, most stores can afford to have only a few guards on duty at a given time. Thus, the guards are only able to watch a small fraction of the total customers in the store, even with video systems installed. Further, the use of such systems are wholly ineffective in preventing theft by employees. Thus, the use of guards and/or video cameras is a high priced, relatively ineffective means of combatting retail theft.

In an effort to improve deterrence of retail theft, many stores have installed security systems which include a detection device located at or near the exit doors of the store and a passive electronic device affixed to the merchandise which causes an alarm to be activated unless the device is removed from the product prior to the customer leaving the store. Removal of the device requires a special tool which is typically maintained behind the sales counter so that the electronic device can be removed at the time of purchase. Once again, such systems suffer from significant limitations and disadvantages. A primary disadvantage is that the passive electronic device which is adapted to be secured to a product is bulky, usually a couple inches in length. Thus, there are numerous products which are simply too small to have such an electronic device secured thereto, such as a package of razor blades or gum, which items are the easiest to steal. Further, the passive electronic device typically has a releasable snap or lock which is only adapted to secure to products such as clothing. In fact, security systems of this type are primarily used in the clothing industry for this reason. Yet another disadvantage is the cost of such electronic passive devices. Because of their expense, the devices can only be secured to more expensive items, such as leather jackets or suits. Moreover, in retail locations such as grocery stores, consumers purchase a large number of items. Removal of a device from every item would require a significant amount of time, thus requiring additional clerks and possibly additional sales counters, thereby further driving up the cost of the products.

Finally, a feature common to most products sold in stores is a bar code representing the universal pricing code (UPC). The bar code is printed on the outside of the product packaging, and is readable by a scanner such as a visible laser diode (VLD). The bar code identifies the product and its pricing in a computer system. When the bar code is read by the VLD at the point of purchase, the computer automatically retrieves pricing information and stores information necessary for inventory tracking. However, printing the bar code on the product is an additional cost which increases the price of the product. To date, there have not been any attempts to combine theft detection, inventory tracking, and pricing information in a single device.

OBJECTS AND SUMMARY OF THE INVENTION

A primary object of the present invention is to provide a device which is extremely small and can be associated with, preferably implanted in, a vast majority of products, virtually irrespective of product size, shape, and texture, to transmit a signal which activates an alarm to prevent theft of the product from the store. An equally important object of the present invention is to provide such a device which transmits a signal which identifies the product so that the signal not only activates the alarm but also identifies the product to facilitate automatic pricing and inventory tracking for the product.

More specifically, it is an object to provide a device comprising a small integrated circuit which remains passive until it receives a frequency signal from an external device, and after receiving the frequency signal, the device becomes active and transmits the frequency code so that the device is compatible with existing alarm systems and visible laser diode (VLD) universal product code (UPC) readers, typically provided in most retail stores.

In another aspect of the invention, it is an object to provide a system adapted to work in conjunction with the device to prevent theft of the product in which the device is implanted and to provide automatic pricing and inventory tracking information for the product. A more particular object is to provide a system using a conventional or existing VLD reader which transmits a frequency signal capable of activating the device from the passive to the active state, and which has circuitry for receiving the frequency code, thereby preventing the need to design and manufacture a new reader device.

For the same reason, it is likewise an object to provide a system using conventional or existing alarm system that transmits a frequency signal which is adapted to activate the device of the present invention, and is adapted to receive the frequency code generated by the device to activate an alarm, if the device is not deactivated prior to the product being taken from the store.

Thus, it is another object to provide a deactivation apparatus which deactivates the device of the present invention to allow the product to be removed from the store without activating the alarm. Importantly, an object is to use a deactivation apparatus which deactivates the device without removing the device from the product, in contrast to prior art systems, to allow the small device to be irremovably implanted in the product or its packaging to prevent removal of the device from the product which would facilitate theft of the product.

To accomplish these and related objectives, a device and system for implementing the device are disclosed for preventing theft of an item from a building and for automating identification of the item. The device comprises frequency activation circuitry, a power source, a switch, a memory device and transmitter circuitry. The memory device stores a code identifying the product. The frequency activation circuitry receives a frequency signal and generates an activation signal. The activation signal causes the switch to couple the power source to the memory to thereby cause the memory device to output the code. The transmitter circuitry is coupled to the memory device to convert the code to a frequency code and to thereafter transmit the frequency code. If the device is used solely for theft prevention, any frequency could be transmitted to activate the security alarm.

In another aspect of the invention, the device is adapted to be secured to an item, and is implemented in conjunction with a system to prevent theft of the item from a building and for providing automatic identification of the item. The system comprises a frequency reader, a deactivating apparatus, and an alarm. The frequency reader is located at a counter of the building for detecting and receiving the frequency code. The deactivating apparatus is also located at the counter for deactivating the device from transmitting the frequency code. Finally, the alarm is located near at least one exit of the building, for receiving the frequency code and for activating an alarm upon receiving the frequency code in the event that the device is not deactivated from transmitting the code prior to the item being taken from the building through the exit.

Thus, the present invention overcomes the problems associated with prior product retail theft detection, pricing information, and inventory tracking systems. The present invention provides an extremely small integrated circuit device which can be implanted in or secured to virtually any product and which transmits a signal to activate an alarm if the device is not deactivated prior to the product being taken from the store. Further, because the device is so small, the product can be implanted in most products so that it cannot be removed prior to purchase without damaging the product or the product packaging. Moreover, the signal transmitted by the device to activate the alarm is a frequency code identifying the product which allows existing VLD readers to provide automatic pricing information as well as to provide automatic inventory tracking in conjunction with existing computer systems. Thus, the dual functioning of the device prevents the need to provide separate devices for theft protection and production information, thereby significantly reducing the price of the product. Further, the integrated circuits can be mass produced for a nominal price and therefore provide not only more effective theft protection but are also more cost effective than existing passive theft protection devices and systems.

DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT

Figure 1:
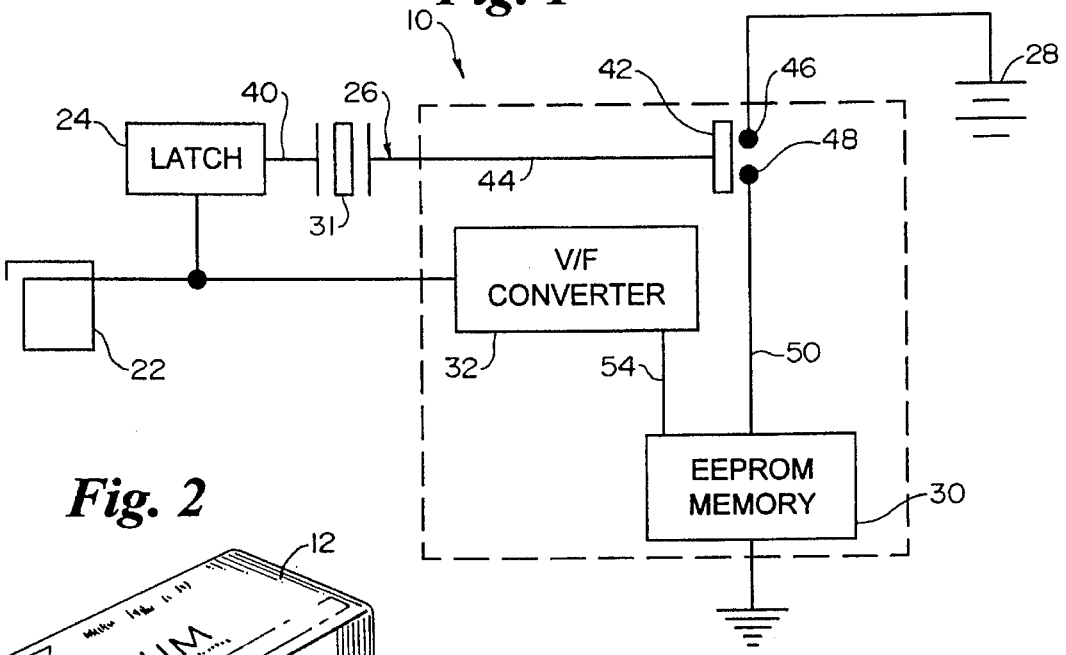
FIG. 1 is a block diagram of the integrated circuit device constructed according to a preferred embodiment of the present invention.
Figure 2:
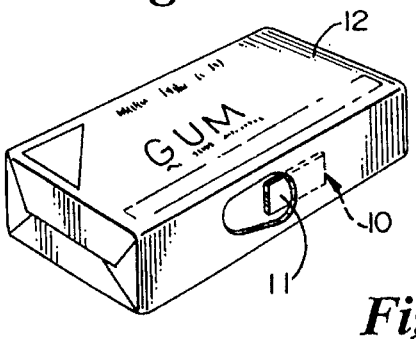
FIG. 2 is a perspective view of a product having the device implanted within the packaging, a portion of the packaging being broken away to reveal the device.
Figure 3:
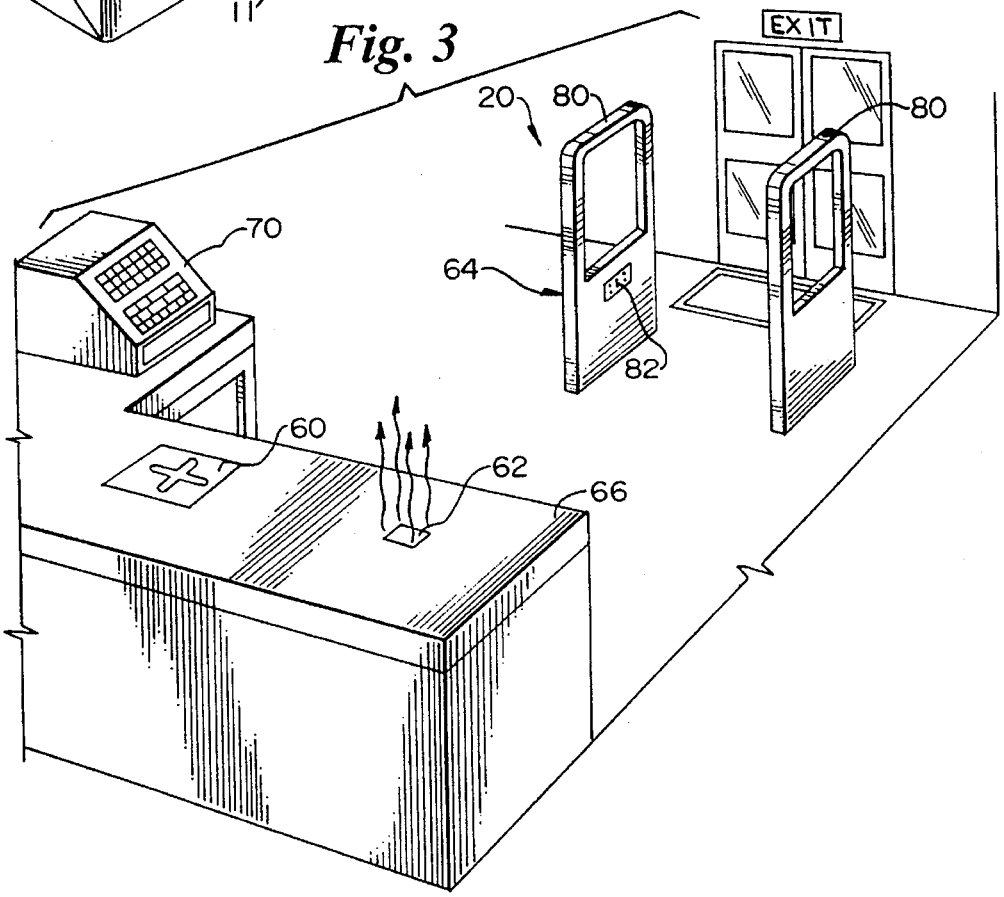
FIG. 3 is a fragmentary perspective view of a store showing a system adapted to be used in conjunction with the device to provide automatic theft protection, pricing information, and inventory tracking.

Referring now to FIG. 1, a device constructed according to a preferred embodiment of the present invention is designated generally by the numeral 10. The device includes an integrated circuit which is shown in FIG. 1 in block diagram form. Referring to FIG. 2, device 10 has a miniature housing 11 to securely and safely enclose the integrated circuit. In another aspect of the invention, device 10 is adapted to be associated with, preferably implanted in, an item 12 or its packaging (shown in FIG. 2) and to be used in conjunction with a system 20, shown in FIG. 3, to prevent theft of the product and to automatically provide pricing information and inventory tracking of the product, as will be described below.

Referring to FIG. 1, device 10 preferably comprises an antenna 22, a latch 24, a switch 26, a power supply 28, a memory device 30 and a voltage to frequency (V/F) converter 32. The antenna 22 is preferably a loop antenna which is adapted to receive a frequency signal, such as would be emitted by a visible laser diode (VLD) reader or existing retail theft detection systems. Device 10 is therefore adapted to work in conjunction with existing retail apparatuses, as will be described below. The loop antenna produces a voltage upon receiving the frequency signal. Antenna 22 is coupled to latch 24 which outputs an activation signal in response to receiving the voltage from the antenna. The latch is preferably a capacitor which is charged by the voltage received from the loop antenna, and then discharges a current.

Switch 26 is coupled to latch 24 as shown in FIG. 1. The switch connects and disconnects power supply 28 to and from memory device 30, respectively. The switch preferably comprises a piezoelectric material 31 coupled between the latch by connection 40 and a contact 42 by connection 44. The current supplied by the capacitor of latch 24 to piezoelectric material 31 causes it to expand and thus closes contact 42 between nodes 46 and 48, thereby coupling power supply 28 to memory device 30. The power supply is preferably a lithium battery.

The memory device is preferably an electronically erasable programmable read-only memory (EEPROM) which is programmed to emit a digital binary code identifying the product when the power supply supplies power to the input 50 of the EEPROM, and thus, when contact 42 is pressed against nodes 46 and 48 by the piezoelectric material. The EEPROM is coupled to V/F converter 32 by connection 54. The V/F converter converts the digital binary code to a frequency code. More specifically, the converter converts a low state binary signal to one frequency and a high state binary signal to another frequency so that an external apparatus can receive the frequency code and identify the product to provide pricing information and inventory tracking, as will be described in greater detail below. V/F converter 32 is coupled to antenna 22. Antenna 22 transmits the frequency code for detection by the external apparatus.

An important concept of the device 10 is that it remains passive until it is activated by a frequency signal supplied by a VLD reader or an alarm system, thus preserving the lithium battery to ensure effective operation of the device at the time of purchase of the corresponding product or to activate an alarm to prevent theft of the product. Once the device is activated by a frequency signal generated by the VLD reader or the alarm system, the device transmits a frequency code which identifies the product and is readable by the VLD reader, as are conventional bar codes, or which activates the alarm to prevent theft of the product in the event that the device is not deactivated prior to the product being taken from the store. Further, because the device typically cannot be readily removed from the product, employee theft is also deterred.

Device 10 is adapted to be used in conjunction with system 20 which comprises a frequency reader 60, a deactivating apparatus 62, and an alarm system 64. The frequency reader is mounted on the top of counter 66, which is shown as a checkout counter typical of many retail stores. The device 60 is preferably a visible laser diode (VLD) reader which, in its conventional application, emits a laser light having a frequency in the light spectrum and is adapted to read a universal price code (UPC) printed on the packaging of or a label for most products which are sold in retail outlets. The VLD reader detects the bar code as the bar code is scanned across the laser light, as is well known in the art. In the system of the present invention, a frequency signal (either radio frequency or laser light frequency) produced at the frequency reader 60 is received by antenna 22 of device 10 to activate the device to emit the frequency code identifying the product, as described above. The VLD reader has existing circuitry for receiving frequency signals which conventionally would be the laser beam deflected off of the UPC bar code. Thus, a conventional VLD reader must be adapted to receive the frequency code transmitted by device 10.

The VLD reader 60 is preferably coupled to a computer system 70 which has means for receiving the frequency code, converting the code to a digital signal, and for processing the digital signal to provide automatic pricing information and inventory tracking as is already well known in the art. The computer can also be programmed to provide an audible signal to alert a store clerk that the VLD reader has received the frequency code so that detection and automatic pricing is verified.

After the frequency code is detected by the VLD reader, the product having device 10 implanted therein should be moved across deactivation apparatus 62 to stop the device from transmitting the frequency code, and thus, to prevent the device from activating alarm system 64 when the product is taken from the store. The deactivation apparatus preferably comprises a high frequency directional emitter which is also mounted flush on the top of counter 66. The emitter emits a high frequency beam upwardly from the counter, and is preferably mounted about a foot (1') behind the VLD reader to ensure that device 10 is not accidentally deactivated prior to the VLD reader receiving the frequency code. The high frequency beam destroys antenna 22 which prevents the device from receiving or transmitting frequency signals, and thus prevents the device from activating the alarm system 64, as will be explained below. The high frequency emitter requires a relatively large power supply, about the size of a car battery. Thus, it would be difficult, if not impossible, for a potential thief to inconspicuously bring such a device into a store to perform unauthorized deactivation of the devices on products in an attempt to steal such products.

Finally, the system 20 includes the alarm system 64. The alarm system can be a conventional alarm system which is adapted to receive a frequency signal and activate an alarm in response thereto to alert store personnel that an item is being stolen. Such conventional alarm systems include parallel spaced apart bars 80 which have circuitry therein for transmitting a frequency signal. Conventionally, the transmitted frequency signal works in conjunction with a passive device, such as a loop antenna, which receives the frequency and in conjunction with other passive elements, generates a very low power signal. The bars 80 also included a receiver circuit for receiving the low power signal, which was coupled to an audible alarm which would be activated if a product bearing the passive device were taken past bars 80. Such bars are located near at least one exit, and typically, all exits used by customers of the store. Device 10 of the present invention is adapted to receive the frequency signal generated by existing alarm systems, such as bars 80, and, as explained above, the device thereafter generates the frequency code identifying the product if the device has not been deactivated. The frequency code is received by the receiver in bars 80 and thereafter activates alarm 82.

In operation, the product having device 10 implanted therein is brought to counter 66 by a customer of the store. The clerk at the counter moves the product past the frequency reader 60 (i.e., typically a VLD) which activates device 10 and receives the frequency code from the device to identify the device to provide pricing information and inventory tracking in conjunction with the computer system 70. The clerk should thereafter move the product, and thus device 10, past deactivation apparatus 62 which prevents the device from transmitting the frequency code. The customer can thereafter take the product through the exit door of the store without activating alarm system 64.

In the event that device 10 is not deactivated, the alarm 82 will be activated when the product is taken past the alarm system, such as spaced apart bars 80. When the alarm is activated, store personnel will be alerted that a product is being stolen from the store.

It should be appreciated that device 10 could be used solely as a theft protection device. In such an embodiment, the memory device could be eliminated. Once the device becomes active after receiving a frequency signal, as described above, the power supply could be coupled directly to a frequency signal generation circuit by switch 26. Such circuits are well known in the art. Because the digital memory is eliminated, the frequency signal generation circuit could be coupled directly to antenna 22 without the voltage to frequency converter. Antenna 22 would transmit the generated frequency to activate alarm 82.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A device adapted to be associated with a product for preventing theft of the product and for emitting a code identifying the product, the device comprising:

frequency activation means for receiving a frequency signal generated by an external source and for generating an activation signal;

a piezoelectric device for receiving the activation signal;

power means for supplying power only after the activation signal is received;

memory means for storing the code, the memory means being coupled to the power means to output the code when power is supplied to the memory means;

switch means with normally open contacts coupled between the memory means and the power means, the switch means being operable in response to the piezoelectric device to couple the power means to the memory means upon the piezoelectric device receiving the activation signal initiated by the frequency activation means; and transmitter means for transmitting the code received from the memory means.

2. The device of claim 1 wherein the frequency activation means comprises an antenna for receiving a radio-frequency signal and a latch which stores the radio-frequency signal and generates the activation signal.

3. The device of claim 2 wherein the antenna is a loop antenna.

4. The device of claim 2 wherein the memory means comprises a memory device for digitally storing the code and for outputting the digital code upon receiving power from the power supply.

5. The device of claim 4 wherein the transmitter means comprises means for converting the digital code to frequencies representing the digital code from the memory means, the frequency converter means being coupled to the antenna so that the antenna transmits the frequencies representing the code.

6. The device of claim 1 wherein the frequency activation means further comprises a latch coupled to an antenna for receiving an induced voltage and thereafter activating the piezoelectric device.

7. The device of claim 2 wherein the latch comprises a capacitor.

8. The device of claim 1 wherein the power means comprises a battery.

9. A device adapted to be associated with a product for preventing theft of the product and for emitting a code identifying the product, the device comprising:

an antenna adapted to receive a radio-frequency signal from an external source and for generating a voltage in response to receiving the radio-frequency signal;

a capacitor coupled to the antenna for storing the antenna voltage and for supplying an activation signal;

a piezoelectric device for receiving the activation signal;

a power supply;

a memory device for digitally storing the code and for outputting the digital code upon receiving power from the power supply;

a switch operably connected to the piezoelectric device, the switch having normally open contacts and being operable in response to the piezoelectric device to couple the power supply to the memory device upon the piezoelectric device receiving the activation signal; and a voltage to frequency converter, coupled to the memory device, for converting the digital code to frequencies representing the digital code, the voltage to frequency converter being coupled to the antenna so that the antenna transmits the frequencies representing the code.

10. A method for preventing theft of an item from a store, the method comprising:

providing a device capable of transmitting an alarm signal from an antenna only in response to an energizing signal;

maintaining the device in a passive, unenergized state by use of a switch means with normally open contacts operable in response to a piezoelectric device to prevent it from transmitting the alarm signal unless the piezoelectric device receives an activation signal developed in response to the energizing signal;

securing the device to the item;

providing an alarm at at least one exit of the store that supplies a localized energizing signal;

disabling the antenna of the device at a sales counter of the store after purchase to prevent the device from transmitting the alarm signal after the item has been purchased; and sending an energizing signal to the device from the alarm to determine whether the device has been disabled;

activating the device to an active, energized state in response to the energizing signal only if the device has not been disabled from transmitting an alarm signal to the alarm; and automatically activating a visual and/or audio theft warning indicator if the alarm signal is transmitted by the device to the alarm.

11. The device of claim 1, wherein the switch means comprises a physical contact switch closed by action of the piezoelectric device.

12. A device for selectively coupling a power means to an electrical load in response to an activation signal, the device comprising:

a piezoelectric device for receiving the activation signal;

power means for supplying power only after the activation signal is received; and switch means with normally open contacts coupled between the electrical load and the power means, the switch means being operable in response to the piezoelectric device to selectively couple the power means to the electrical load upon the piezoelectric device receiving the activation signal.

13. The device of claim 12 further comprising frequency activation means for receiving a frequency signal generated by an external source and for generating the activation signal.

14. The device of claim 13 wherein the frequency activation means comprises an antenna for receiving a radio-frequency signal and a latch which stores the radio-frequency signal and generates the activation signal.

15. The device of claim 14 wherein the antenna is a loop antenna.

16. The device of claim 13 wherein the frequency activation means further comprises a latch coupled to an antenna for receiving an induced voltage and thereafter activating the piezoelectric device.

17. The device of claim 16 wherein the latch comprises a capacitor.

18. The device of claim 12 wherein the power means comprises a battery.

* * * * *